US010350675B2

(12) United States Patent
Properzi

(10) Patent No.: US 10,350,675 B2
(45) Date of Patent: Jul. 16, 2019

(54) MACHINE FOR MANUFACTURING CONTINUOUS BARS OF NONFERROUS METAL BY CONTINUOUS CASTING

(71) Applicant: Giulio Properzi, Milan (IT)

(72) Inventor: Giulio Properzi, Milan (IT)

( * ) Notice: Subject to any disclaimer, the term of this patent is extended or adjusted under 35 U.S.C. 154(b) by 36 days.

(21) Appl. No.: 15/427,321

(22) Filed: Feb. 8, 2017

(65) Prior Publication Data

US 2017/0225224 A1 Aug. 10, 2017

(30) Foreign Application Priority Data

Feb. 8, 2016 (IT) ..... 102016000012482

(51) Int. Cl.
*B22D 11/06* (2006.01)
*B22D 11/00* (2006.01)

(52) U.S. Cl.
CPC ..... *B22D 11/0685* (2013.01); *B22D 11/001* (2013.01); *B22D 11/0602* (2013.01); *B22D 11/0605* (2013.01); *B22D 11/0608* (2013.01); *B22D 11/0631* (2013.01); *B22D 11/0654* (2013.01); *B22D 11/0677* (2013.01)

(58) Field of Classification Search
CPC ..... B22D 11/0685; B22D 11/001; B22D 11/0602; B22D 11/0605; B22D 11/0608; B22D 11/0631; B22D 11/0654; B22D 11/0677
See application file for complete search history.

(56) References Cited

U.S. PATENT DOCUMENTS

2003/0102105 A1* 6/2003 Properzi ..... B22D 11/0608 164/479

FOREIGN PATENT DOCUMENTS

EP 1317980 A1 6/2003
JP 6049840 A 3/1985

* cited by examiner

*Primary Examiner* — Kevin P Kerns
*Assistant Examiner* — Steven S Ha
(74) *Attorney, Agent, or Firm* — Cantor Colburn LLP

(57) ABSTRACT

A machine for manufacturing continuous bars of nonferrous metal by continuous casting includes a movable casting shell, composed of segments arranged in succession, each one having a portion defined, with a bottom and flanks, of the casting shell, and open on the sides directed toward the contiguous segments. The contiguous segments are movable along a closed path that has a substantially rectilinear portion at the casting region. Along the portion, the segments are substantially aligned and define a portion of the casting shell, with bottom and flanks, which is continuous, substantially rectilinear and closed, for at least one portion of the path downstream of the casting region, by a closure component.

11 Claims, 3 Drawing Sheets

MACHINE FOR MANUFACTURING CONTINUOUS BARS OF NONFERROUS METAL BY CONTINUOUS CASTING

CROSS REFERENCE TO RELATED APPLICATIONS

This application is related to and claims the benefit of Italian Patent Application No. 102016000012482, filed on Feb. 8, 2016, the contents of which are herein incorporated by reference in their entirety.

TECHNICAL FIELD

The present disclosure relates to a machine for manufacturing continuous bars of nonferrous metal by continuous casting.

BACKGROUND

Conventional technology is now established for producing nonferrous ingots using a continuous casting machine fitted with a moveable and rectilinear casting shell composed of a plurality of concatenated casting segments or bodies with a U-shaped cross-section in succession, each one with bottom and flanks but open on the sides directed toward the contiguous segments.

The segments, which form a chain, can move along a closed path that has at least one first substantially rectilinear portion at the casting and cooling region where they define a moving canal, being supported by suitable rails.

Downstream of this rectilinear portion, the path of the chain of casting bodies continues around a braked pinion that brings the chain, now slack, downward until it reaches a second pinion, arranged on the same plane as the first and motorized and hauling, which brings it back upward and to the rectilinear portion.

A metallic belt covers the aforementioned canal, defining the fourth side of the closed and continuous shell along the rectilinear portion. The belt moves at the same speed as the casting bodies of the underlying chain, and is kept in position and under tension by three rollers. The first roller is arranged above the point where the casting nozzle or crucible introduces the molten metal; the second roller, which is motorized, is arranged above the point where the solidified metal bar leaves the continuous shell; the third roller, which is the tension roller (or pulley), has its axis compulsorily parallel to those of the first two and is in a higher position with respect to these.

Means of cooling by sprays of water or water/air strike the belt and the bottom of the casting bodies, or all four sides of the moveable shell, allowing the solidification of the metal. The spray nozzles can be regulated for areas both under pressure and under flow.

One of these machines is disclosed in EP1317980 B1. Such patent shows the machine only schematically, solely in order to explain its principle of operation; in fact, in the graphic representation, the entire system for moving the rollers for transporting the belt, including the essential tension roller, is omitted.

A practical implementation of this machine, which on the world market is often called Track and Belt in order to distinguish it from other continuous shell machines such as the Properzi Wheel and Belt machine, or the Belts and Side Dams machine, also known as Hazelett, is shown in FIG. 1.

In FIG. 1, the letter A designates the supporting structure of the machine, the letter B designates the driving motor pinion and the letter C designates the resisting pinion which causes the compression of the chain D of casting bodies E along the rectilinear portion of their path in which the molten metal is cast. F designates the metallic belt, while G and H designate the supporting rollers of the belt respectively at the point of pouring the molten metal and the point of disengagement of the casting bodies from the bar in the step of solidification, and I designates the tension roller or pulley. L designates the means of moving the rollers and the tension pulley I. The letter M designates the means, constituted by rollers or by sliders, for pressing the belt against the edges of the continuous casting shell with their movement device. N designates the cooling nozzles and O designates the crucible for pouring the metal. The dotted lines show the position of the belt and of the corresponding supporting and movement elements when it is being substituted.

In industrial use, this machine has displayed some problems.

One of these problems, which derives from the offset of the various elements, is the difficulty of succeeding in obtaining a seal between the belt and the casting bodies that is such as to prevent infiltrations of liquid metal at the start of pouring, and misuse of the belt which shortens its useful life.

In fact, in a machine of the type described above, tensioning the belt as much as possible in order to keep it as rectilinear as possible, and using generic presser means to ensure the contact between the belt and the underlying casting bodies for the whole rectilinear path, as indicated in EP1317980 B1, have produced results that are not entirely satisfactory.

In fact, even a very slight non-parallelism of the axes of the three rollers results in deformations and undulations in the belt; this is combined with uncertain positioning of the presser means and hence the malfunctioning thereof (short lifetime of the belt) and possibly also interruption of the casting.

Furthermore, owing to maintenance requirements and changing the belt, which is worn down by the thermal cycles undergone in one or more work shifts, it is necessary that both the tension roller (pulley) and the other two rollers or supporting rollers be provided with a movement away from the continuous shell (canal) which, in conventional machines, is obtained by mounting the rollers on arms that rotate about pins that are machined on the supporting structure that constitutes the footing of the entire machine and which also supports the pinions: the hauling pinion and the resisting pinion of the chain of casting bodies. Such arms can be moved with hydraulic, pneumatic or electrical movement means.

In this configuration according to the known art, it has been found that it is possible for liquid metal to penetrate between the casting bodies and the belt; this phenomenon is due to the fact that it is practically impossible, with such configuration described above, to ensure the necessary precision in the parallelism of the rollers that guide the belt and the pinions that move the casting shell and also the correct positioning of the presser means.

In fact, in industrial implementations, this type of casting machine, which can reach 4 meters in height and a length that can vary from 3 to 6 meters and beyond, has considerable measurements and it is practically impossible, even by taking the greatest care, for all the reaming operations, performed on separate parts, of all the axes of all the rotating elements described above to be parallel to within tolerances that are exact enough to prevent distortion and fleeting of the belt and the ineffectiveness of the sliders or presser rollers, and consequent penetration of metal.

SUMMARY

The aim of the present disclosure is to solve the above mentioned problems, by providing a machine for manufacturing continuous bars of nonferrous metal by continuous casting, of the Track and Belt type, that ensures greater precision in the arrangement and in the movement of the elements that support and actuate the belt, so as to effectively prevent penetrations of metal between the casting bodies and the belt.

Within this aim, the disclosure provides a machine that ensures an excellent seal between the belt and the casting bodies while allowing the movement of the belt in order to carry out necessary maintenance operations.

The disclosure also provides a machine that offers high reliability and which requires reduced maintenance operations.

The disclosure further provides a machine that can be provided and run at low cost for long periods of continuous operation.

These advantages, which will become better apparent hereinafter, are achieved by providing a machine for manufacturing continuous bars of nonferrous metal by continuous casting, which comprises a movable casting shell composed of a plurality of segments arranged in succession, each one having a portion defined, with bottom and flanks, of said casting shell, and open on the sides directed toward the contiguous segments; said segments being movable along a closed path that has a substantially rectilinear portion at the casting region; along said portion of path, said segments being substantially aligned and defining a portion of the casting shell, with bottom and flanks, which is continuous, substantially rectilinear and closed, for at least one portion of the path downstream of the casting region, by closure means at its side that lies opposite with respect to the bottom; downstream of said substantially rectilinear portion, said path of the segments having a change of direction for the progressive disengagement of said casting shell from the metal bar produced by the solidification of the metal in the casting shell; said closure means comprising a belt which extends along a closed path and is supported by corresponding supporting means, means being provided for pressing a substantially rectilinear portion of said belt, which faces said substantially rectilinear portion of the path of the segments, against the side of said segments that is opposite with respect to their bottom, characterized in that said means for supporting the belt comprise at least two supporting rollers and at least one tension roller, which have mutually parallel axes that are oriented substantially at right angles to said substantially rectilinear portion of the path of the segments, said supporting rollers being mounted in a fixed position on a same beam which extends substantially parallel to said substantially rectilinear portion of the path of the segments.

BRIEF DESCRIPTION OF THE DRAWINGS

Further characteristics and advantages of the disclosure will become better apparent from the description of a preferred, but not exclusive, embodiment of the machine according to the disclosure, which is illustrated by way of non-limiting example in the accompanying drawings wherein.

DETAILED DESCRIPTION OF THE DRAWINGS

Figure 1:
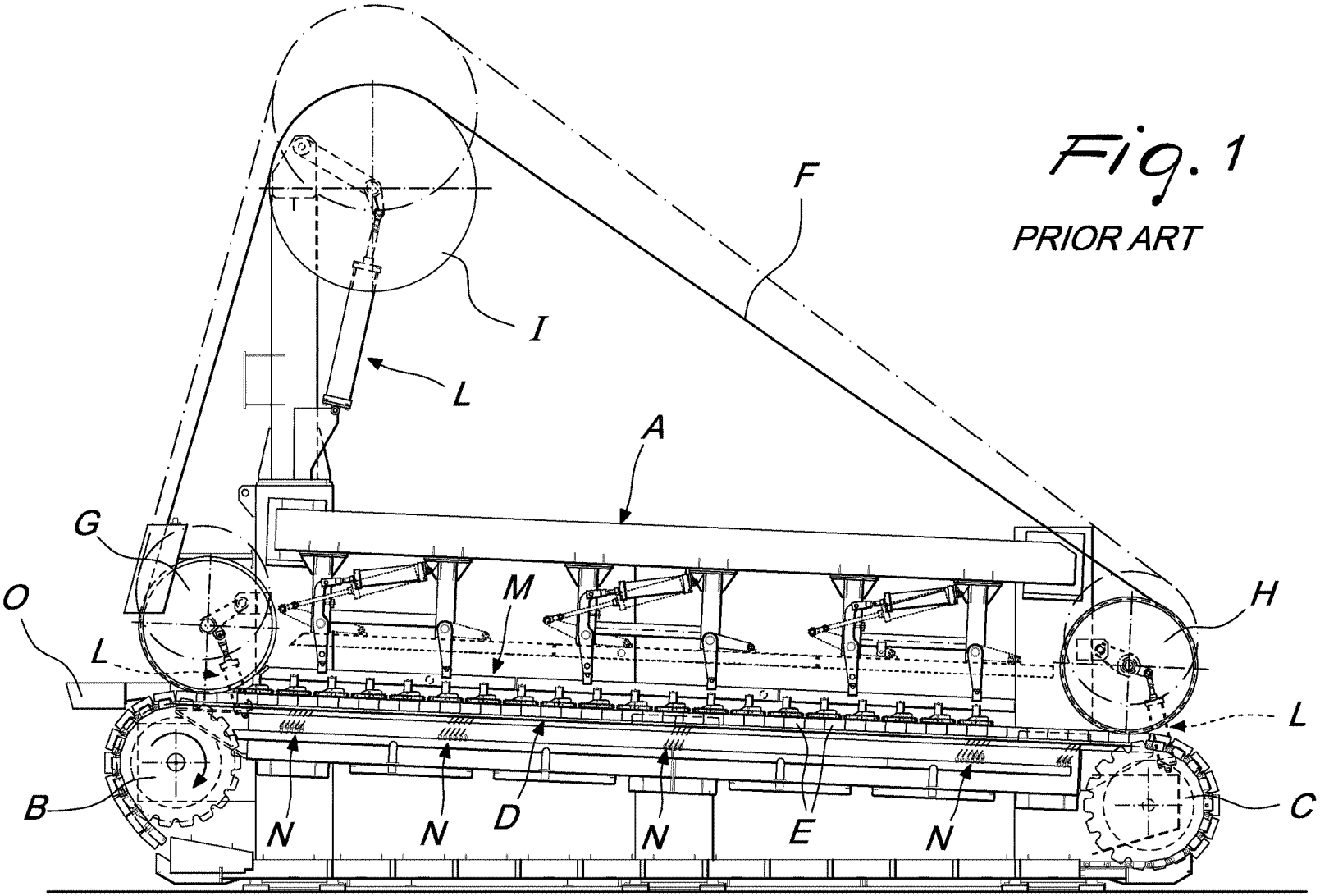
Fig. 1 PRIOR ART
FIG. 1 shows a continuous casting machine of the Track and Belt type, provided according to the prior art.
Figure 2:
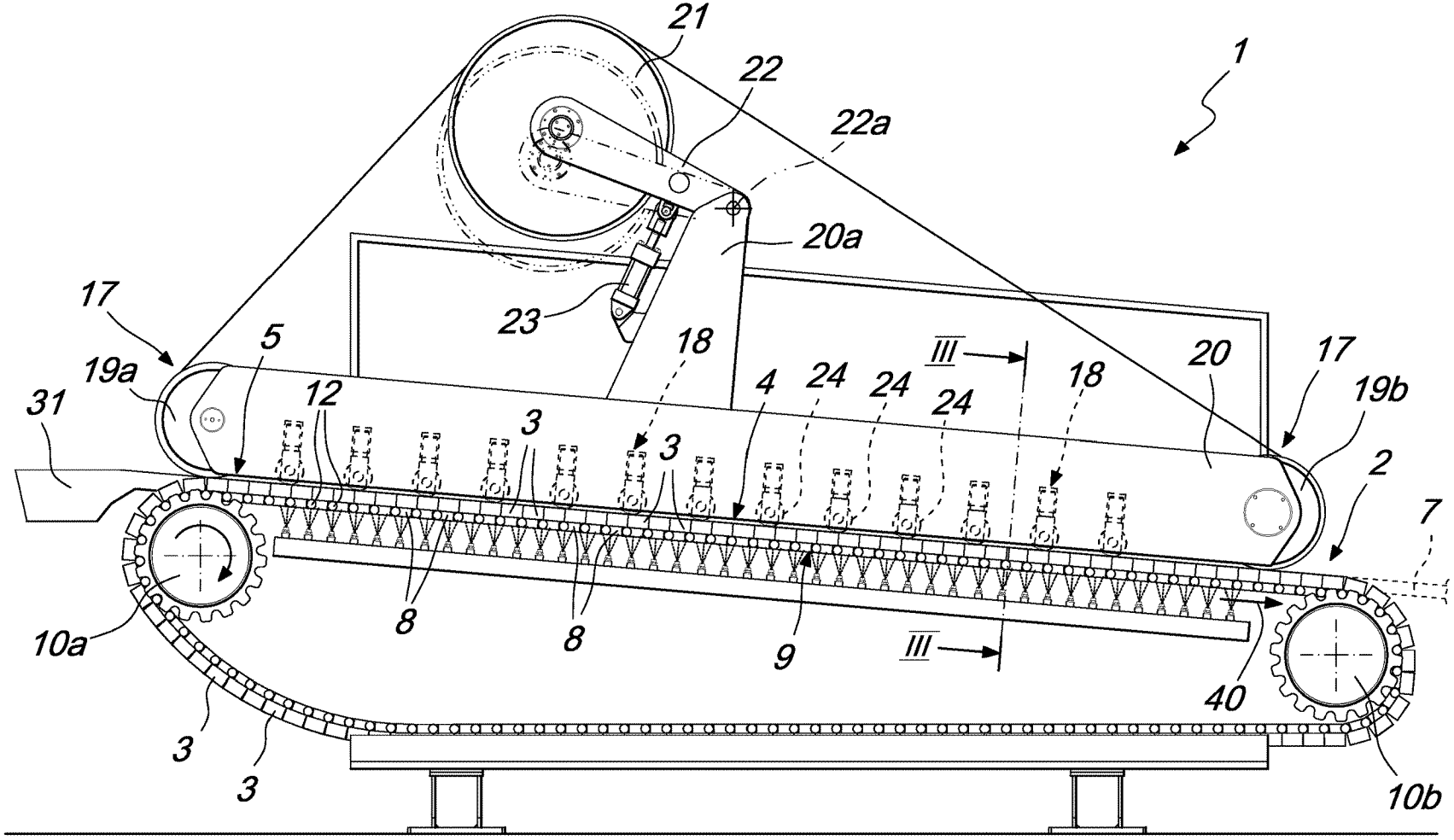
FIG. 2 schematically shows a machine according to the disclosure.
Figure 3:
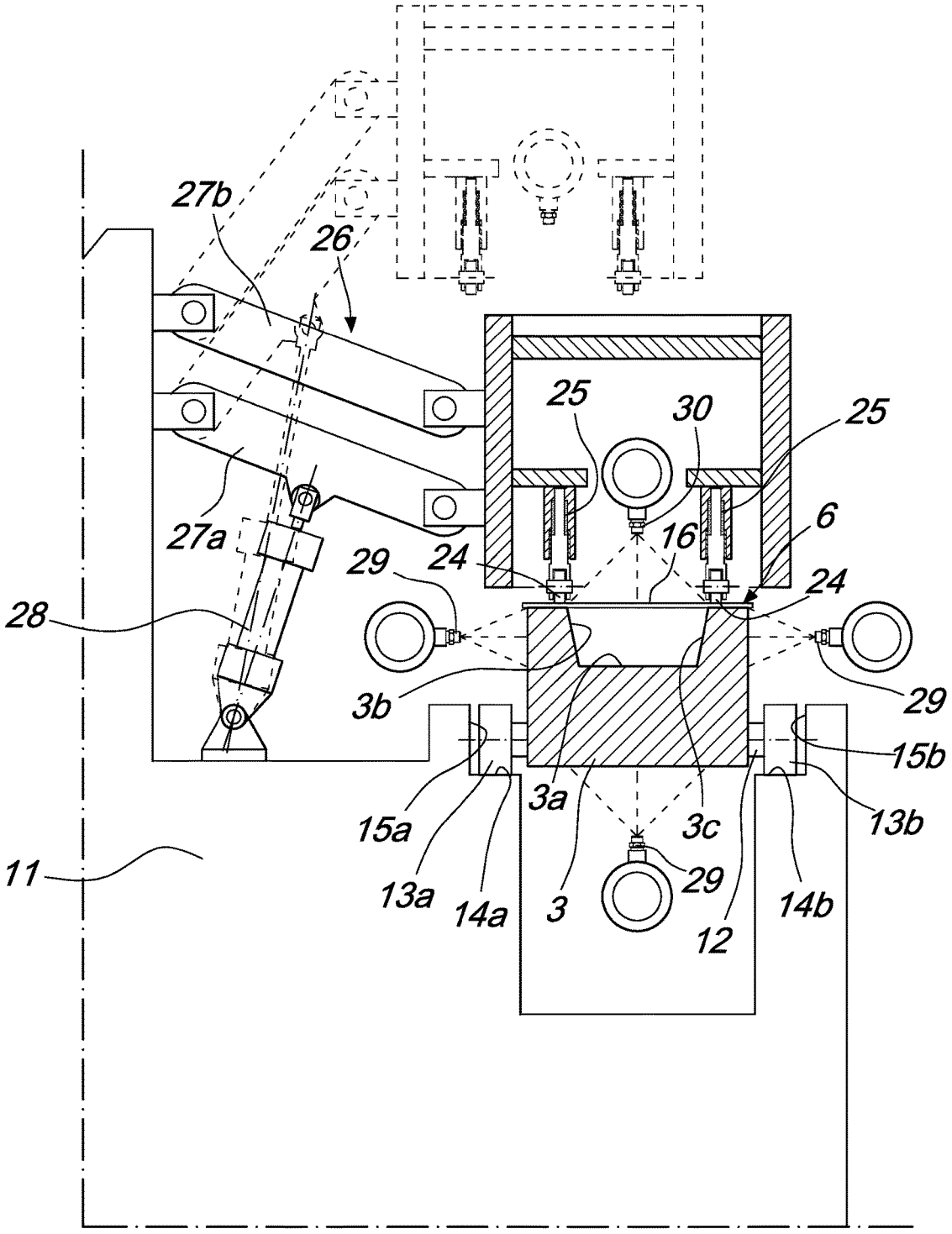
FIG. 3 is an enlarged schematic cross-section view of FIG. 2, taken along the line III-III.

With reference to FIGS. 2 and 3, a machine according to the disclosure, generally designated by the reference numeral 1, comprises a moveable casting shell 2.

The casting shell 2 is composed of a plurality of concatenated segments 3, which are arranged in succession and which can move along a path that has at least one rectilinear portion 4 at the casting region 5.

FIG. 3 shows that, in each one of the segments 3, a portion is defined with a bottom 3*a* and flanks 3*b*, 3*c* of the casting shell 2, which is open on its sides directed toward the contiguous segments 3 as well as on its opposite side with respect to the bottom 3*a*.

Along the portion 4, the segments 3 are substantially aligned and define a portion of the casting shell 2. Such portion of the casting shell 2 is movable, continuous, and rectilinear and it is closed, for a portion thereof downstream of the casting region 5, by closure means 6 at its side that is opposite with respect to the bottom 3*a* of the various segments 3 that make it up.

Downstream of the portion 4, the path of the segments 3 undergoes a change of direction that causes the progressive disengagement of the casting shell 2 from the bar 7 deriving from the solidification of the metal in the casting shell 2.

Conveniently, the segments 3, at the portion 4, have their side, opposite with respect to the bottom 3*a*, directed upward.

The portion 4 extends slightly inclined by at least 3° downward according to the direction of advancement 40 of the segments 3 along the corresponding path.

In more detail, the segments 3 are connected to the links 8 of a chain 9, closed, which is wound on at least two pinions 10*a*, 10*b* with horizontal and mutually parallel axes, which are supported by the fixed supporting structure 11 of the machine.

The portion 4 of the path of the segments 3 is defined by the upper branch of the chain 9 which extends between the pinions 10*a*, 10*b*. The pinion 10*a* can be actuated with a rotary motion about its own axis, in a way that is known per se, in order to produce the advancement of the chain 9 and therefore of the segments 3 along the path defined by the chain 9, while the other pinion 10*b* is conveniently braked so that the segments 3, along the portion 4, are pressed up against each other.

The links of the chain 9 are articulated to each other by way of pins 12 the axes of which are parallel to the axes of the pinions 10*a*, 10*b* which mesh with the central region of the pins 12.

Conveniently, along the portion 4 of the path of the segments 3, there are means for supporting and guiding the chain 9 that carries the segments 3.

More specifically, on the pins 12, proximate to their axial ends, laterally to the links of the chain 9 and on mutually opposite sides, two idle wheels 13*a*, 13*b* are mounted as shown in FIG. 3 and, at the portion 4, there are two tracks 14*a*, 14*b*, mutually parallel and delimited laterally by corresponding flanks 15*a*, 15*b*, on which the wheels 13*a*, 13*b* rest.

The closure means 6 of the side of the casting shell 2 that is opposite with respect to the bottom 3*a* comprise a belt 16, preferably made of steel, which is slightly wider than the casting shell 2 defined by the segments 3 and can move along a path that faces the portion 4 with a rectilinear portion thereof.

The belt 16 is supported by corresponding support means 17 and, on its rectilinear portion that faces the portion 4, pressing means 18 act which press it against the edges of the upper side of the casting shell 2 defined by the segments 3 along the portion 4.

According to the disclosure, the support means 17 comprise at least two supporting rollers 19*a*, 19*b* which have axes that are horizontal, mutually parallel and oriented substantially at right angles to the portion 4 of the path of the segments 3. These supporting rollers 19*a*, 19*b* are mounted in a fixed position on a same beam 20 which extends substantially parallel to the portion 4 of the path of the segments 3.

Conveniently, the pressing means 18 are also mounted on the beam 20.

More specifically, the supporting rollers 19*a*, 19*b*, the axes of which are parallel to the axes of the pinions 10*a*, 10*b*, are supported, so that they can rotate about their axes, by the beam 20 which can move toward or away from the portion 4, as will be better described below.

The belt 16 is a closed loop and is wound on supporting rollers 19*a*, 19*b* and on a tension roller 21.

The belt 16, which advances at the same speed as the segments 3, can be moved by friction by contact with the segments 3 and/or by the actuation of at least one of the supporting rollers 19*a*, 19*b*.

The tension roller 21 engages with an area of the belt 16 that is outside the portion of the belt 16 that faces the substantially rectilinear portion 4 of the casting shell 2.

The tension roller 21 is supported, so that it can rotate about its own axis, which is parallel to the axes of the supporting rollers 19*a*, 19*b*, by an arm 22 which is pivoted, about a corresponding pivoting axis 22*a* parallel to the axis of the tension roller 21, to a branch 20*a* of the beam 20. The arm 22 can rotate with respect to the beam 20 about the pivoting axis 22*a*, for example by the action of a fluid-operated actuation cylinder 23, in order to increase or reduce the tension of the belt 16, as shown by the dotted lines in FIG. 2.

In practice, the belt 16 extends along a closed path that has a substantially triangular shape structure, with the vertices defined by the two supporting rollers 19*a*, 19*b* and by the tension roller 21.

The pressing means 18 comprise a plurality of rollers 24 or sliders which are mounted on the beam 20 and are elastically pressed, by way of corresponding springs 25, against the side of the belt 16 that is opposite with respect to the segments 3 along the portion of the belt 16 which faces the substantially rectilinear portion 4 of the path of the segments 3.

Conveniently, the beam 20 is connected to the fixed supporting structure 11 of the machine by way of an articulated parallelogram 26 made up of a pair of mutually parallel linkages 27*a*, 27*b* which are pivoted, with one end thereof, to the fixed supporting structure 11 and, with the other end thereof, to a flank of the beam 20. The mutually parallel pivoting axes of the linkages 27*a*, 27*b* are substantially perpendicular to the axes of the supporting rollers 19*a*, 19*b*.

The rotation of the pair of linkages 27*a*, 27*b*, which causes the movement of the beam 20 parallel thereto, in the embodiment shown is obtained by way of a fluid-operated actuation cylinder 28, but it can be obtained by way of another actuator of known type.

Advantageously, there are means of cooling the metal poured into the casting shell 2, and also of the elements of the machine that come into contact with the poured metal. Such cooling means comprise a plurality of nozzles 29 for dispensing a cooling fluid (generally water) which are facing both below and laterally to the segments 3 along the portion 4, so as to strike the lower side and the flanks thereof with the cooling liquid.

The cooling means also comprise a plurality of nozzles 30 for dispensing a cooling fluid which are facing above the portion of the belt 16 that, in each instance, engages with the segments 3 along the portion 4, so as to strike the upper face of the belt 16 engaged with the segments 3 with the cooling fluid.

The portion of the casting shell 2 defined in each one of the segments 3 preferably has, in a transverse cross-section with respect to the advancement direction of the segments 3 along the path imposed by the chain 9, an isosceles trapezoid shape structure, open at the longer base.

The metal in the melted state is fed, by way of a crucible 31, proximate to the top of the portion of the path of the segments 3.

Operation of the machine according to the disclosure is similar to that of the machine described in EP1317980 B1. The metal, which is poured from the crucible 31 into the portion of the casting shell 2 defined by the segments 3 along the portion 4, progressively solidifies forming a continuous bar 7 that gradually disengages from the casting shell 2 at the end of the portion 4 of the path of the segments 3 proximate to the pinion 10*b*.

It is important to note that, in the machine according to the disclosure, the bores of the beam 20 in order to provide the seats of the shafts for the supporting rollers 19*a*, 19*b* and for the arm 22 that carries the tension roller 21 can all be carried out with a single placing of the beam 20, which can be made of welded steel, on an adapted boring machine. This ensures a parallelism of the axes of the supporting rollers 19*a*, 19*b* and of the tension roller 21 within the smallest possible tolerances. By virtue of this fact, it is possible to obtain a high degree of precision in the parallelism between the axes of the rollers 19*a*, 19*b*, 21 and the axes of the pinions 10*a*, 10*b* that move the casting shell 2, thus appreciably reducing the danger of infiltration of liquid metal between the belt 16 and the casting shell 2.

The preferred arrangement of the belt-tensioning rollers 24 or sliders on the beam 20 makes it possible to obtain a high level of efficacy in pressing the various regions of the belt 16 against the movable casting shell 2 and therefore to achieve a high level of reliability in the seal between the belt 16 and the casting shell 2.

In the machine according to the disclosure, the mounting and the removal of the belt 16 can be carried out in a simple manner by way of moving the beam 20 preferably by way of the articulated parallelogram 26 which ensures the maintenance of the parallelism of all the axes of the rotating elements of the machine.

The high precision achievable in providing the seats for the shafts of the supporting rollers 19*a*, 19*b*, and the fact that the belt-tensioning rollers 24 or sliders are mounted on the same beam 20 in which these seats are provided, make it possible to exactly reposition these elements and the belt 16 with each production cycle.

In practice it has been found that the machine according to the disclosure fully achieves the set aim, since it eliminates or substantially reduces the danger of distortion or fleeting of the belt, thus improving the efficacy of pressing the belt against the casting shell.

The machine, thus conceived, is susceptible of numerous modifications and variations. Moreover, all the details may be substituted by other, technically equivalent elements.

In practice the materials employed, provided they are compatible with the specific use, and the dimensions, may be any according to requirements and to the state of the art.

What is claimed is:

1. A machine for manufacturing continuous bars of nonferrous metal by continuous casting, which comprises a movable casting shell composed of a plurality of segments arranged in succession, each one having a portion defined, with a bottom and flanks, of said casting shell, and open on sides directed toward the plurality of segments; said plurality of segments being movable along a closed path that has a rectilinear portion at a casting region; along said closed path, said plurality of segments being aligned and defining a portion of the casting shell, with bottom and flanks, which is continuous, rectilinear and closed, for at least one portion of a path downstream of the casting region, by closure means at a side that lies opposite with respect to the bottom; downstream of said rectilinear portion, said path of the plurality of segments having a change of direction for a progressive disengagement of said casting shell from a metal bar produced by solidification of the metal in the casting shell; said closure means comprising a belt which extends along a closed path and is supported by corresponding supporting means, means being provided for pressing a rectilinear portion of said belt, which faces said rectilinear portion of the path of the plurality of segments, against a side of said plurality of segments that is opposite with respect to their bottom, wherein said means for supporting the belt comprise at least two supporting rollers and at least one tension roller, which have mutually parallel axes that are oriented substantially at right angles to said rectilinear portion of the path of the plurality of segments, said at least two supporting rollers being mounted in a fixed position on a same beam which extends parallel to said rectilinear portion of the path of the plurality of segments, wherein said beam can move on command toward or away from said rectilinear portion of the path of the plurality of segments.

2. The machine according to claim 1, wherein said pressing means are mounted on said beam.

3. The machine according to claim 1, wherein said at least one tension roller engages said belt externally to said portion of the belt that faces said rectilinear portion of the path of the plurality of segments, said at least one tension roller being supported by an arm which is pivoted to a branch of said beam about a pivoting axis which is parallel to the axis of said at least one tension roller, said arm being rotatable on command about said pivoting axis in order to increase or reduce the tension of said belt along its path.

4. The machine according to claim 1, wherein said belt extends along a path that has a triangular shape with the vertices defined by said at least two supporting rollers and by said at least one tension roller.

5. The machine according to claim 1, wherein said pressing means of said belt comprise a plurality of rollers or sliders that are mounted on said beam and are pressed elastically against the side of said belt that is opposite with respect to said plurality of segments along the portion of said belt that faces said rectilinear portion of the path of the plurality of segments.

6. The machine according to claim 1, wherein said beam is connected to a fixed supporting structure by way of an articulated parallelogram.

7. The machine according to claim 1, wherein, along said rectilinear portion of the path of the plurality of segments, said casting shell has an opposite side with respect to the bottom directed upward.

8. The machine according to claim 1, wherein said rectilinear portion of the path of the plurality of segments extends at an angle of at least 3° downward along an advancement direction of said plurality of segments along the corresponding path; a point of introduction of molten metal into said casting shell being arranged proximate to a top of said rectilinear portion of the path of the plurality of segments, said belt facing with the rectilinear portion of the belt subtended between said at least two supporting rollers above said rectilinear portion of the path of the plurality of segments.

9. The machine according to claim 1, further comprising means for cooling said plurality of segments and said belt along said rectilinear portions of the corresponding mutually facing paths.

10. A machine for manufacturing continuous bars of nonferrous metal by continuous casting, which comprises a movable casting shell composed of a plurality of segments arranged in succession, each one having a portion defined, with a bottom and flanks, of said casting shell, and open on sides directed toward the plurality of segments; said plurality of segments being movable along a closed path that has a rectilinear portion at a casting region; along said closed path, said plurality of segments being aligned and defining a portion of the casting shell, with bottom and flanks, which is continuous, rectilinear and closed, for at least one portion of a path downstream of the casting region, by closure means at its side that lies opposite with respect to the bottom; downstream of said rectilinear portion, said path of the segments having a change of direction for a progressive disengagement of said casting shell from a metal bar produced by solidification of the metal in the casting shell; said closure means comprising a belt which extends along a closed path and is supported by corresponding supporting means, means being provided for pressing a rectilinear portion of said belt, which faces said rectilinear portion of the path of the plurality of segments, against a side of said plurality of segments that is opposite with respect to their bottom, wherein said means for supporting the belt comprise at least two supporting rollers and at least one tension roller, which have mutually parallel axes that are oriented at right angles to said rectilinear portion of the path of the plurality of segments, said at least two supporting rollers being mounted in a fixed position on a same beam which extends parallel to said rectilinear portion of the path of the plurality of segments, wherein said beam is connected to a fixed supporting structure by way of an articulated parallelogram.

11. A machine for manufacturing continuous bars of nonferrous metal by continuous casting, which comprises a movable casting shell composed of a plurality of segments arranged in succession, each one having a portion defined, with a bottom and flanks, of said casting shell, and open on sides directed toward the plurality of segments; said plurality of segments being movable along a closed path that has a rectilinear portion at a casting region; along said closed path, said plurality of segments being aligned and defining a portion of the casting shell, with bottom and flanks, which is continuous, rectilinear and closed, for at least one portion of a path downstream of the casting region, by closure means at its side that lies opposite with respect to the bottom; downstream of said rectilinear portion, said path of the segments having a change of direction for a progressive disengagement of said casting shell from a metal bar produced by solidification of the metal in the casting shell; said closure means comprising a belt which extends along a closed path and is supported by corresponding supporting means, means being provided for pressing a rectilinear portion of said belt, which faces said rectilinear portion of the path of the plurality of segments, against a side of said plurality of segments that is opposite with respect to their bottom, wherein said means for supporting the belt comprise at least two supporting rollers and at least one tension roller, which have mutually parallel axes that are oriented at right angles to said rectilinear portion of the path of the plurality of segments, said at least two supporting rollers being mounted in a fixed position on a same beam which extends parallel to said rectilinear portion of the path of the plurality of segments, wherein said rectilinear portion of the path of the plurality of segments extends at an angle of at least 3° downward along an advancement direction of said plurality of segments along the corresponding path; a point of introduction of molten metal into said casting shell being arranged proximate to a top of said rectilinear portion of the path of the plurality of segments, said belt facing with its rectilinear portion subtended between said at least two supporting rollers above said rectilinear portion of the path of the plurality of segments.

* * * * *